US011198176B2

(12) United States Patent
Hou et al.

(10) Patent No.: US 11,198,176 B2
(45) Date of Patent: Dec. 14, 2021

(54) METHOD FOR CASTING ALUMINUM IN ROTOR

(71) Applicants: FUJIAN PUHUI TECHNOLOGY DEVELOPMENT CO., LTD, Fujian (CN); Jibo Hou, Fujian (CN); Hongbin Zhen, Fujian (CN)

(72) Inventors: Jibo Hou, Fujian (CN); Hongbin Zhen, Fujian (CN); Songling Shi, Fujian (CN)

(73) Assignees: FUJIAN PUHUI TECHNOLOGY DEVELOPMENT CO., LTD, Fujian (CN); Jibo Hou, Fujian (CN); Hongbin Zhen, Fujian (CN)

( * ) Notice: Subject to any disclaimer, the term of this patent is extended or adjusted under 35 U.S.C. 154(b) by 0 days.

(21) Appl. No.: 17/259,874

(22) PCT Filed: Jul. 15, 2019

(86) PCT No.: PCT/CN2019/095995

§ 371 (c)(1),
(2) Date: Jan. 12, 2021

(87) PCT Pub. No.: WO2020/015608

PCT Pub. Date: Jan. 23, 2020

(65) Prior Publication Data

US 2021/0308751 A1 Oct. 7, 2021

(30) Foreign Application Priority Data

Jul. 20, 2018 (CN) ..... 201810801154.9

(51) Int. Cl.
*B22D 18/04* (2006.01)
*B22D 19/00* (2006.01)
(Continued)

(52) U.S. Cl.
CPC ..... *B22D 41/015* (2013.01); *B22D 18/04* (2013.01); *B22D 19/0054* (2013.01);
(Continued)

(58) Field of Classification Search
CPC B22D 18/04; B22D 19/0054; B22D 19/0081; B22D 27/045
See application file for complete search history.

(56) References Cited

U.S. PATENT DOCUMENTS 4,093,413 A * 6/1978 Schollhorn ..... B22D 17/24 425/110
5,215,141 A * 6/1993 Kuhn ..... B22D 18/04 164/133
8,403,026 B2 3/2013 Osborne et al.

FOREIGN PATENT DOCUMENTS

CN 1122065 A 5/1996
CN 101847913 A 9/2010
(Continued)

*Primary Examiner* — Kevin E Yoon
(74) *Attorney, Agent, or Firm* — Greer, Burns & Crain, Ltd.

(57) ABSTRACT

A method for casting aluminum on a rotor, comprising: installing casting equipment on a casting workbench and storing enough molten aluminum in the casting equipment, wherein the casting equipment comprises an heat preserving furnace and an electromagnetic pump arranged at a side of the heat preserving furnace; assembling a plurality of rotor iron cores with a plurality of dies respectively and preheating outside the casting workbench; installing the plurality of preheated dies on a plurality of liquid outlet gates at a top end of the electromagnetic pump, wherein each liquid outlet gate is matched with a liquid inlet gate of the dies; heating and keeping the installed die in a multi-stage heating mode; controlling the pressurizing pressure of the electromagnetic pump in time-period when the electromagnetic pump is used for casting; and after completing casting, moving the plu-
(Continued)

rality of dies out of the casting workbench to be cooled. According to the method for casting aluminum through the rotor, the casting efficiency is improved by reasonably distributing the heating time and the one-time multi-casting mode; the top-down temperature gradient is matched with accurate pressure control, so that the compensation capacity is improved.

10 Claims, 2 Drawing Sheets

(51) Int. Cl.
*B22D 27/04* (2006.01)
*B22D 41/015* (2006.01)
*B22D 39/00* (2006.01)

(52) U.S. Cl.
CPC ..... *B22D 19/0081* (2013.01); *B22D 27/045* (2013.01); *B22D 39/003* (2013.01)

(56) References Cited

FOREIGN PATENT DOCUMENTS

| | | | | |
|---|---|---|---|---|
| CN | 103658599 | A | 3/2014 | |
| CN | 206597892 | U | 10/2017 | |
| CN | 107511469 | A | 12/2017 | |
| CN | 109202040 | A | 1/2019 | |
| DE | 2557645 | A1 * | 6/1977 | ..... B22D 19/0054 |
| DE | 3831802 | C1 | 2/1990 | |
| JP | 07213031 | A | 8/1995 | |
| WO | WO-2014071481 | A2 * | 5/2014 | ..... B22D 27/045 |

* cited by examiner

METHOD FOR CASTING ALUMINUM IN ROTOR

CROSS-REFERENCE TO RELATED APPLICATIONS

This application is a U.S. national stage application of PCT/CN2019/095995 filed Jul. 15, 2019 which claims the benefit of priority to Chinese Patent Application CN 201810801154.9 filed Jul. 20, 2018, the entire disclosures of which are incorporated herein by reference.

TECHNICAL FIELD

The present invention relates to the technical field of casting aluminum on motor rotors, and in particular to a method for casting aluminum on rotor.

BACKGROUND ART

The rotor consists of an upper short circuit ring, a lower short circuit ring, a guide bar connected between the upper short circuit ring and the lower short circuit ring and a rotor iron core; the upper short circuit ring, the lower short circuit ring and the guide bars are collectively referred to as a squirrel cage, and the squirrel cage is cast by adopting a method for casting aluminum on rotor.

At present, the method for casting aluminum on rotor commonly used in the market is pressure casting, which is essentially a method of filling the die cavity with liquid or semi-liquid metal at a higher speed under high pressure, and forming and solidifying under pressure to obtain castings. The pressure casting has the characteristics of fast filling and high efficiency; however, it is well known that the rotor aluminum castings produced therefrom have many defects such as pores and shrinkage holes, which cause the resistance of the squirrel cage to increase and the efficiency of the motor to decrease.

Low pressure casting uses lower pressures than pressure casting and is therefore named. The product quality of low-pressure casting is obviously improved compared with that of pressure casting, but due to the fact that the gas pressure mode is adopted for casting filling, the casting still has the defects of air holes, shrinkage holes and cold shuts in the condensation process.

CN1122065A discloses a low-pressure casting method of a squirrel-cage rotor, wherein the method heats and assembles a die in three times to realize directional solidification of aluminum, which is beneficial to feeding and effectively improves the quality of the cast aluminum rotor. However, the production efficiency is affected by heating and disassembling in three times.

SUMMARY OF THE INVENTION

The purpose of the present invention is to overcome the above-mentioned problems in the prior art and provide a method for rotor casting aluminum, which improves casting efficiency by reasonably allocating heating time and one-time multiple pouring; and through top-down temperature gradient and precise pressure control cooperates to improve the feeding capacity.

In order to achieve the above objectives of the present invention, the following technical solutions are provided:

A method for casting aluminum on a rotor, comprising: installing casting equipment on a casting workbench and storing enough molten aluminum in the casting equipment, wherein the casting equipment comprises an heat preserving furnace and an electromagnetic pump arranged at a side of the heat preserving furnace; assembling a plurality of rotor iron cores with a plurality of dies respectively and preheating outside the casting workbench; installing the plurality of preheated dies on a plurality of liquid outlet gates at a top end of the electromagnetic pump, wherein each liquid outlet gate is matched with a liquid inlet gate of the dies; heating and keeping the installed die in a multi-stage heating mode; controlling the pressurizing pressure of the electromagnetic pump in time-period when the electromagnetic pump is used for casting; and after completing casting, moving the plurality of dies out of the casting workbench to be cooled.

Preferably, the liquid outlet of the electromagnetic pump is provided with a liquid container used for storing and insulating the aluminum liquid pumped into the electromagnetic pump; wherein the liquid container is provided with a liquid inlet matched with the liquid outlet of the electromagnetic pump at a bottom end, and the plurality of liquid outlet gates at the top end.

Preferably, the heating and keeping the installed die in a multi-stage heating mode comprises: sheathing four-section heating coil outside the die, and setting heating temperatures of the top-down arranged four-section heating coil to 400° C., 450° C., 500° C. and 550° C.; wherein the heating coil of adjacent sections are arranged in close proximity, and the height of the die is matched with the height of the four-section heating coil.

Preferably, a plurality of the four-section heating coils are installed on a support frame by a lifting mechanism, the support frame being installed around the electromagnetic pump; and wherein, before the installed die is heated and kept, the lifting mechanism is controlled to drive the four-section heating coil to move downwards to enable the four-section heating coil to be sheathed outside the die.

Preferably, the rotor iron core is pressed by a pressing device before the installed die is heated and kept.

Preferably, the pressing device is installed on the support frame and located above the four-section heating coil, the pressing device having an ejector pin for pressing the rotor iron core. Preferably, the controlling the pressurizing pressure of the electromagnetic pump in time period comprises: dividing a total casting time of the electromagnetic pump evenly into multiple periods, and setting a pressurizing pressure and maintaining the pressure in each period; wherein, the pressurization pressure in the initial period is minimum, the pressurization pressure in the end period is maximum, and pressurization is performed for one cycle every two intermediate periods.

Preferably, the pressurization pressure for the initial period of time is 0.1 Pa, the pressurization pressure for the termination period of time is 0.25 Pa, and the pressurization pressure of the two intermediate periods is 0.2 Pa and 0.15 Pa respectively.

Preferably, the preheating temperature is 300-600° C.

Preferably, an electric heating device is installed in the liquid container.

The beneficial effects of the present invention are embodied in the following aspects:

1) According to the invention, the die is assembled and preheated, as well as cooled and disassembled outside the casting workbench, and the die is heated and kept on the casting workbench, greatly reducing the time occupied by assembly and preheating as well as cooling and disassembly, and improving casting production efficiency;

2) a liquid container with a plurality of liquid outlet gates is arranged at a liquid outlet of the electromagnetic pump, so that a plurality of dies can be simultaneously cast, realizing one-time multi-casting, and greatly improving production efficiency;

3) according to the present invention, by setting the top-down heating temperature gradient on the die, and making the lower part temperature higher than the upper part temperature, it is beneficial to fill the entire cavity with molten aluminum entering the die cavity from bottom to top, and achieve a top-down sequential solidification, which is beneficial for sequential feeding while purifying the purity of aluminum; and 4) according to the present invention, by utilizing the characteristic that the pressure of the direct-current electromagnetic pump is accurately controllable, when aluminum liquid is sequentially solidified, the pressure is accurately controlled in time period to achieve the purpose of feeding and exhausting, and to improve the quality of cast aluminum.

DESCRIPTION OF REFERENCE NUMERALS

1—heat preserving furnace; 2—electromagnetic pump; 20—liquid container; 20*a*—liquid inlet; 20*b*—liquid outlet gate; 3—support frame; 4—pressing device; 5—die; 5*a*—liquid inlet gate; 501—lower die; 502—dummy shaft; 503—upper die; 504—rotor iron core; and 6—heating coil.

DETAILED DESCRIPTION OF THE INVENTION

Figure 1:
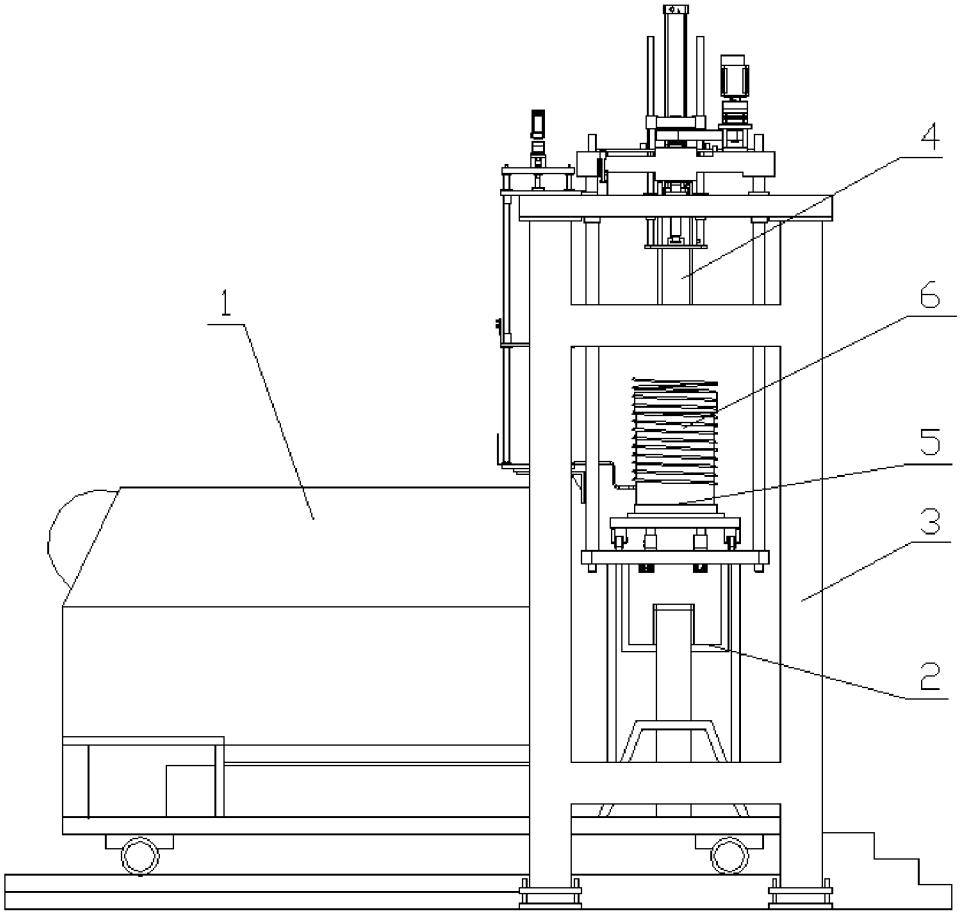
FIG. 1 is a schematic diagram of the structure of a device for implementing the method for casting aluminum on rotor of the present invention.

The invention provides a method for casting aluminum on a rotor, which is suitable for all products of cast-aluminum rotor motors, and is especially suitable for casting slender rotors. The present invention provides a method for casting aluminum through a rotor and equipment for implementing the method. As shown in FIG. 1, equipment for implementing the method includes: casting equipment arranged on a casting workbench, wherein the casting equipment includes an heat preserving furnace 1 and an electromagnetic pump 2 arranged on a side of the heat preserving furnace 1; a support frame 3 installed around the electromagnetic pump 2; a plurality of pressing devices 4 and a plurality of four-section heating coils 6 installed on the support frame 3 respectively correspond to a plurality of dies 5 to be cast. The four-section heating coil 6 is installed on the support frame 3 through a lifting mechanism, and the pressing device 4 is installed above the four-section heating coil 6.

The method for casting aluminum on the rotor provided by the present invention includes the following steps: storing enough molten aluminum in the heat preserving furnace 1 and the electromagnetic pump 2; assembling a plurality of rotor iron cores with the plurality of dies 5 respectively and preheating outside a casting workbench; installing the plurality of preheated dies 5 at a top end of the electromagnetic pump 2; heating and insulating the installed die 5 in a multi-stage heating mode; controlling the electromagnetic pump to cast, and continuously adjusting the pressure; and moving the plurality of dies 5 out of the casting workbench to be cooled and disassembled.

Wherein, the assembling and preheating of rotor iron core and die 5, as well as cooling and disassembling of the die are performed outside the casting workbench, and heating and insulating of the die 5 are performed on the casting workbench, greatly reducing the time occupied by assembly and preheating as well as cooling and disassembly, and improving casting production efficiency.

The present invention will now be described in detail with reference to the accompanying drawings and examples.

Figure 2:
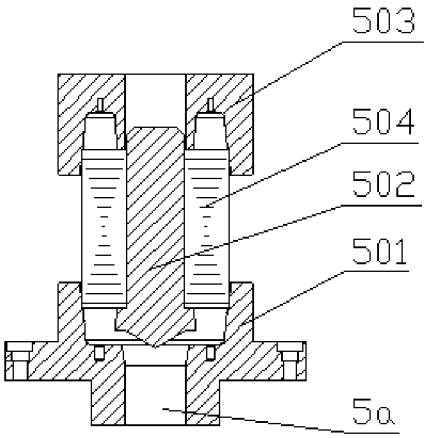
FIG. 2 is a schematic view showing the assembly of a rotor iron core and a die according to the present invention.

As shown in FIG. 2, the die 5 includes: a lower die 501 having a liquid inlet gate 5*a* for installing at a lower end of the rotor iron core 504; an upper die 503 for installing on an upper end of the rotor iron core 504; a dummy shaft 502 installed in the center of the rotor iron core 504.

After the lower die 501, the upper die 503, and the dummy shaft 502 are assembled with the rotor iron core 504, the die 5 is preheated at a preheating temperature of 300-600° C. for more than 20 minutes. The preheating may be performed by induction heating, resistance heating, direct contact direct current resistance heating and gas heating. Due to the fact that the preheating time is relatively long, the die is assembled and preheated outside the casting workbench in advance, which greatly shortening the heating time on the casting workbench, and improving the casting production efficiency.

Figure 3:
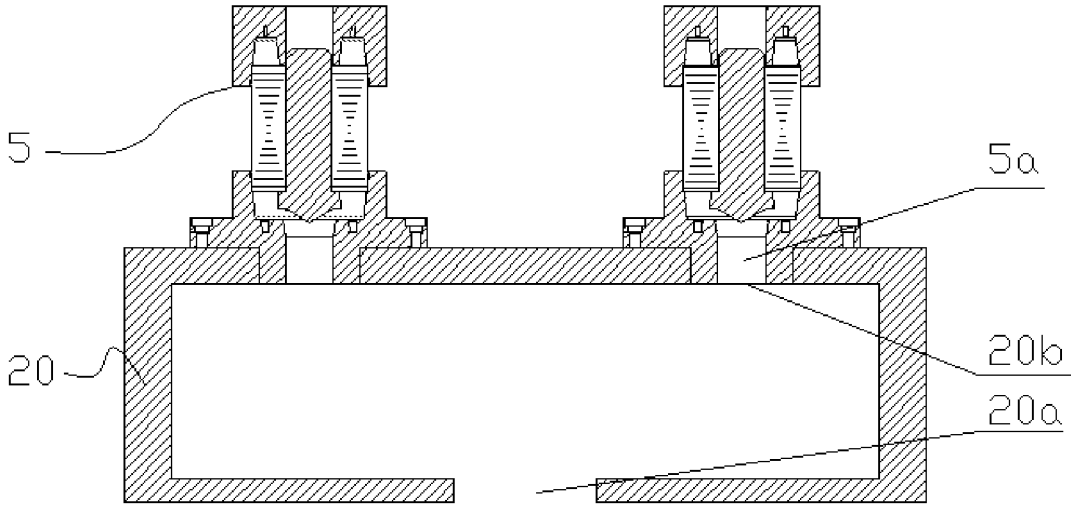
FIG. 3 is a schematic illustration of the assembly of a liquid outlet container with a die in one embodiment of the present invention.

When preheated to a suitable temperature, the die 5 is installed on top of the electromagnetic pump 2. As shown in FIG. 3, a liquid outlet of the electromagnetic pump 2 (not shown) is provided with a liquid outlet container 20. The liquid outlet container 20 is provided with a liquid inlet 20*a* matched with the liquid outlet of the electromagnetic pump 2 at a bottom end, and the plurality of liquid outlet gates 20*b* at the top end at the same level. Each liquid outlet gate 20*b* is matched with the liquid inlet gate 5*a* of the die. This embodiment shows two liquid outlet gates 20*b*, and two dies can be cast simultaneously. The number of the liquid outlet gates 20*b* can be set according to the die to be cast, thereby realizing one-time multi-casting, and greatly improving the production efficiency.

The liquid outlet container 20 is internally provided with an electric heating device for storing and heating the aluminum liquid pumped thereto by the electromagnetic pump 2, wherein the temperature of the aluminum liquid is 700-720° C. The electrical heating device may be a resistance heating device.

After the die 5 is installed at the top end of the electromagnetic pump 2, the lifting mechanism is controlled to drive the four-section heating coil 6 to move downwards, so that the four-section heating coil 6 is sheathed outside the die 5; and the compressing device 4 is controlled to compress the rotor iron core. Specifically, heating coils 6 of adjacent sections of the four-section heating coil 6 are arranged next to each other, and are driven by the lifting mechanism to move downwards simultaneously. Preferably, the height of the die 5 is matched to the height of the four-section heating coil 6 sheathed on the outside thereof in order to achieve heating and insulation of the different top-down sections of the die.

Preferably, the pressing device 4 of the embodiment is installed at the top of the support frame 3, the pressing device 4 can be a pneumatic cylinder or a hydraulic cylinder. The ejector pin of the pneumatic cylinder or the hydraulic cylinder is used for pressing the lamination of the rotor iron core, thereby guaranteeing the compactness of the lamination of the rotor iron core, and avoiding looseness and aluminum leakage in the aluminum casting process.

After the lamination of the rotor iron core is compacted, the die is heated and insulated by using four-section heating coil 6. Since there is a temperature loss during the transfer of the die after pre-heating to the casting workbench, this example heats the die for 5 seconds before casting to meet the casting temperature requirement. In practice, the heating coil 6 employs an intermediate frequency induction heating coil, and the heating temperatures of the top-down arranged four-section heating coil 6 are respectively set to 400° C., 450° C., 500° C. and 550° C. Here, the heating coil 6 is divided into several sections that can be set according to the rotor height. Due to the fact that the die is preheated outside the casting workbench in advance, the heating time on the casting workbench is greatly shortened, and the casting production efficiency is improved. It should be noted that the specific heating time before casting varies depending on the size and shape of the rotor, and whether the heating temperature meets the requirements can be obtained by a temperature monitoring device such as a temperature sensor.

And when the die reaches the set temperature, the electromagnetic pump is controlled to start casting. During the casting process, the top-down heating temperature of the die is always kept constant, that is, 400° C., 450° C., 500° C. and 550° C., by real-time control of the temperature. Through constant temperature control, cold shuts caused by heat dissipation of the rotor in the casting process can be avoided. In addition, according to the present invention, by setting the top-down heating temperature gradient on the die, and making the lower part temperature higher than the upper part temperature, it is beneficial to fill the entire cavity with molten aluminum entering the die cavity from bottom to top, and achieve a top-down sequential solidification, which is beneficial for sequential feeding while purifying the purity of aluminum.

The electromagnetic pump of the present invention is preferably a DC electromagnetic pump. The DC electromagnetic pump uses the electromagnetic force as the conveying pressure of the aluminum liquid. Under the condition that the magnetic induction intensity is determined, the electromagnetic force and the electrode current have a strict linear relationship, so that the pressure can be accurately controlled by changing the current.

In this embodiment, when the molten aluminum is solidified sequentially, the feeding is realized by precisely controlling the pressure.

Specifically, during casting, the total casting time is divided into multiple time periods, and the pressurization and pressure maintaining of the electromagnetic pump are accurately controlled in each time period, thereby realizing feeding. The pressurization pressure in the initial period is the minimum, the pressurization pressure in the end period is the maximum, and the pressurization is performed for one cycle every two intermediate periods, so that it is beneficial for the molten aluminum to fill the entire cavity and achieve the purpose of exhaust and feeding.

In this embodiment, the rotor height is 400; the total casting time of 12 s is divided into 6 periods, and every 2 s is one period. Specifically, according to the embodiment, the pressurization and pressure maintaining of the electromagnetic pump per period are set as follows: 0.1 Pa-2 s, 0.2 Pa-2 s, 0.15 Pa-2 s, 0.2 Pa-2 s, 0.15 Pa-2 s, and 0.25 Pa-2 s. During the sequential solidification of the molten aluminum, this embodiment precisely controls the pressurization and pressure maintaining of the electromagnetic pump to enhance the feeding capability and achieve the purpose of sequential feeding.

After the casting is completed, the pressing device 4 and the four-section heating coil 6 is controlled to move upward, and then the die is moved out of the casting workbench to continue the next round of casting. And the die moved out of the casting workbench is cooled and disassembled. In order to accelerate cooling, a water-cooling mode can be adopted for the dummy shaft, so that the dummy shaft can be taken out quickly.

In order to prolong the life of the parts (lower die 501, upper die 503, dummy shaft 502 and liquid outlet container 20) that are in contact with aluminum liquid, and avoid corrosion from aluminum and wear, the parts adopt high temperature resistant steel and treated with surface coating. The high-temperature resistant steel can be metal materials such as heat-resistant steel and cast iron, and the coating is made of a material which is non-wetting with aluminum, corrosion-resistant and high-hardness, such as metal compounds SiC, SiN, WC, AlN, CrN, and ternary or quaternary compounds. The coating method can be PVD, ion spraying and other technologies.

The equipment for implementing the method further comprises a control system for controlling the pressure and the temperature; and up and down movement of the pressing device 4 and the heating coil 6, the start and stop of the heating coil 6, the start and stop of the electromagnetic pump and the like.

Although the present invention has been described in detail above, the present invention is not limited to this. Those skilled in the art can make modifications based on the principles of the present invention. Therefore, all modifications made in accordance with the principles of the present invention should be understood as falling into the scope of the present invention.

What is claimed is:

1. A method for casting aluminum on rotor, comprising:

installing casting equipment on a casting workbench and storing enough molten aluminum in the casting equipment, wherein the casting equipment comprises an heat preserving furnace and an electromagnetic pump arranged at a side of the heat preserving furnace, characterized in that, the method further comprises: assembling a plurality of rotor iron cores with a plurality of dies respectively and preheating outside the casting workbench;

installing the plurality of preheated dies on a plurality of liquid outlet gates at a top end of the electromagnetic pump, wherein each liquid outlet gate is matched with a liquid inlet gate of the dies;

controlling a lifting mechanism to drive a four-section heating coil to move downwards to enable the four-section heating coil to be sheathed outside the die;

heating and keeping the installed die in a multi-stage heating mode that makes temperature of a lower part of the die higher than that of an upper part of the die to achieve sequential solidification from the upper part to the lower part;

controlling the pressurizing pressure of the electromagnetic pump in time period when the electromagnetic pump is used for casting; and after completing casting, moving the plurality of dies out of the casting workbench to be cooled.

2. The method for casting aluminum on rotor according to claim 1, characterized in that, a liquid outlet of the electromagnetic pump is provided with a liquid container for storing and keeping the aluminum liquid pumped into the electromagnetic pump; wherein, the liquid container is provided with a liquid inlet matched with the liquid outlet of the electromagnetic pump at a bottom end, and the plurality of liquid outlet gates at the top end.

3. The method for casting aluminum on rotor according to claim 2, characterized in that, the heating and keeping the installed die in a multi-stage heating mode comprises: setting heating temperatures of the top-down arranged four-section heating coil to 400° C., 450° C. 500° C. and 550° C.; wherein the heating coil of adjacent sections are arranged in close proximity, and the height of the die is matched with the height of the four-section heating coil.

4. The method for casting aluminum on rotor according to claim 3, characterized in that, a plurality of the four-section heating coils are installed on a support frame by a lifting mechanism, the support frame being installed around the electromagnetic pump.

5. The method for casting aluminum on rotor according to claim 4, characterized in that, the rotor iron core is pressed by a pressing device before the installed die is heated and held.

6. The method for casting aluminum on rotor according to claim 5, characterized in that, the pressing device is installed on the support frame and located above the four-section heating coil, the pressing device having an ejector pin for pressing the rotor iron core.

7. The method for casting aluminum on rotor according to claim 6, characterized in that, the controlling the pressurizing pressure of the electromagnetic pump in time period comprises:

dividing a total casting time of the electromagnetic pump evenly into multiple periods, and setting a pressurizing pressure and maintaining the pressure in each period; wherein, the pressurization pressure in the initial period is minimum, the pressurization pressure in the end period is maximum, and pressurization is performed for one cycle every two intermediate periods.

8. The method for casting aluminum on rotor according to claim 7, wherein the pressurization pressure for the initial period of time is 0.1 Pa, the pressurization pressure for the termination period of time is 0.25 Pa, and the pressurization pressure of the two intermediate periods is 0.2 Pa and 0.15 Pa respectively.

9. The method for casting aluminum on rotor according to claim 3, characterized in that, the preheating temperature is 300-600° C.

10. The method for casting aluminum on rotor according to claim 2, characterized in that, an electric heating device is installed in the liquid container.

* * * * *